United States Patent [19]

Durai-Swamy

[11] 4,324,642

[45] Apr. 13, 1982

[54] PYROLYSIS PROCESS FOR PRODUCING CONDENSED STABILIZED HYDROCARBONS UTILIZING A BENEFICIALLY REACTIVE GAS

[75] Inventor: Kandaswamy Durai-Swamy, Culver City, Calif.

[73] Assignee: Occidental Research Corporation, Irvine, Calif.

[21] Appl. No.: 181,597

[22] Filed: Aug. 26, 1980

[51] Int. Cl.[3] ..... C10C 1/00; C10B 43/00

[52] U.S. Cl. ..... 208/8 LE; 208/8 R; 208/11 LE; 208/11 R; 201/2.5; 585/240

[58] Field of Search ..... 208/8 R, 8 LE, 11 R, 208/11 LE; 201/2.5

[56] References Cited

U.S. PATENT DOCUMENTS

| | | | |
|---|---|---|---|
| 1,940,648 | 12/1933 | Russell | 208/8 LE |
| 3,488,278 | 1/1970 | Nelson | 208/8 LE |
| 3,617,513 | 11/1971 | Wilson et al. | 208/8 |
| 3,700,583 | 10/1972 | Salamony et al. | 208/8 |
| 3,717,570 | 2/1973 | Hechman et al. | 208/210 |
| 3,726,784 | 4/1973 | Correa et al. | 208/8 |
| 3,736,233 | 5/1973 | Sass et al. | 201/17 |
| 3,839,186 | 10/1974 | Berger | 208/8 |
| 4,022,680 | 5/1977 | Maa | 208/8 |
| 4,036,731 | 7/1977 | Martin | 208/8 |
| 4,051,012 | 9/1977 | Plumlee et al. | 208/8 |
| 4,085,030 | 4/1978 | Green et al. | 208/8 |
| 4,135,982 | 1/1979 | Green | 201/12 |
| 4,145,274 | 3/1979 | Green et al. | 208/8 |
| 4,162,959 | 7/1979 | Duraiswamy | 208/8 R |
| 4,166,786 | 9/1979 | Duraiswamy et al. | 208/8 R |
| 4,222,844 | 9/1980 | Nizamoff | 208/8 LE |
| 4,225,415 | 9/1980 | Mirza et al. | 208/8 R |
| 4,250,014 | 2/1981 | Long et al. | 208/8 R X |

OTHER PUBLICATIONS

Desulfurization Via Hydrogen Donor Reactions, G. Doyle, Corporate Research Laboratories, Exxon, Jul. 1975, pp. 1–21.

*Primary Examiner*—Delbert E. Gantz
*Assistant Examiner*—William G. Wright
*Attorney, Agent, or Firm*—Forrest E. Logan

[57] ABSTRACT

In a process for recovery of values contained in solid carbonaceous material, the solid carbonaceous material is comminuted and then subjected to pyrolysis, in the presence of a carbon containing solid particulate source of heat and a beneficially reactive transport gas in a transport flash pyrolysis reactor, to form a pyrolysis product stream. The pyrolysis product stream contains a gaseous mixture and particulate solids. The solids are separated from the gaseous mixture to form a substantially solids-free gaseous stream which comprises volatilized hydrocarbon free radicals newly formed by pyrolysis. Preferably the solid particulate source of heat is formed by oxidizing part of the separated particulate solids. The beneficially reactive transport gas inhibits the reactivity of the char product and the carbon-containing solid particulate source of heat. Condensed stabilized hydrocarbons are obtained by quenching the gaseous mixture stream with a quench fluid which contains a capping agent for stabilizing and terminating newly formed volatilized hydrocarbon free radicals. The capping agent is partially depleted of hydrogen by the stabilization and termination reaction. Hydrocarbons of four or more carbon atoms in the gaseous mixture stream are condensed. A liquid stream containing the stabilized liquid product is then treated or separated into various fractions. A liquid containing the hydrogen depleted capping agent is hydrogenated to form a regenerated capping agent. At least a portion of the regenerated capping agent is recycled to the quench zone as the quench fluid. In another embodiment capping agent is produced by the process, separated from the liquid product mixture, and recycled.

17 Claims, 3 Drawing Figures

PYROLYSIS PROCESS FOR PRODUCING CONDENSED STABILIZED HYDROCARBONS UTILIZING A BENEFICIALLY REACTIVE GAS

BACKGROUND ART

The present invention is directed to a process for producing condensed stabilized hydrocarbons by flash pyrolysis of solid particulate carbonaceous material.

Fluid fossile fuels, such as oil and natural gas, are becoming scarce as these fuels are consumed by a world whose population is continually growing. As a consequence, considerable attention is being directed toward pyrolyzing solid carbonaceous materials such as coal to useful liquid and gaseous hydrocarbon products. Pyrolysis processes vary widely and include transport flash pyrolysis where pyrolysis occurs under turbulent flow conditions. A problem exists in maximizing the yield of liquid hydrocarbons having molecular weights useful for conversion to more valuable end products because of the presence of newly formed volatilized hydrocarbon free radicals in the volatilized pyrolytic vapor.

One of the first steps in the pyrolysis of carbonaceous material is the thermal generation of hydrocarbon free radicals via homolytic bond scission of the coal. These hydrocarbon free radicals will combine with each other to produce undesirable heavy molecules such as heavy viscous tars having high boiling points. These hydrocarbon free radicals will also combine with carbon sites, such as present on char, to form more char or coke.

A technique that has been used to upgrade tar liquids and improve middle distillate tar liquid yield, is the addition of gaseous hydrogen directly to the pyrolysis reactor. By hydrogenating volatilized hydrocarbons directly in the pyrolysis reaction zone, sulfur and nitrogen are removed as hydrogen sulfide and ammonia. Hydrogenation directly in the pyrolysis zone also reduces the viscosity and lowers the average boiling point of the subsequently condensed volatilized hydrocarbons by terminating some hydrocarbon free radicals before they are allowed to polymerize to heavy tar liquids.

Processes involving hydrogenation are disclosed in U.S. Pat. Nos. 4,162,959 and 4,166,786 both of which are incorporated herein by reference. These patents disclose a process wherein a carbonaceous material feed, hot heat supplying carbon-containing residue, and hydrogen gas are reacted in a transport flash pyrolysis reactor. Pyrolysis and hydrogenation of the pyrolysis products occur simultaneously.

The effectiveness of hydrogen gas in terminating hydrocarbon free radicals is directly related to the hydrogen partial pressure. The pyrolysis reactor is preferably operated at pressures slightly greater than ambient, although pressures up to about 10,000 psig may also be used. An increase in hydrogen partial pressure increases free radical termination. High pressures, however, increase both the capital and operational cost of pyrolysis. Therefore, the preferred hydropyrolysis pressure for economical operation is from about 1 psig to about 1000 psig.

Tar polymerization and cracking occur rapidly at pyrolysis temperatures. To minimize cracking pyrolysis vapors are rapid cooled and condensed by either direct or indirect heat exchange. Rapid cooling and condensation, although preventing some tar from cracking, are still not satisfactory in preventing a significant portion of the tar from polymerizing by free radical recombination in the liquid state.

A pyrolysis process is therefore needed which substantially eliminates undesirable volatilized hydrocarbon free radical reactions early in the formation of pyrolysis products, thereby increasing the yield of desirable lower molecular weight tar liquids having relatively low boiling points and decreasing the yield of undesirable heavy viscous tars having relatively high boiling points.

SUMMARY AND DISCLOSURE OF THE INVENTION

This invention relates to a process for recovery of values produced from a solid carbonaceous material containing bound hydrogen atoms. In general a solid particulate carbonaceous feed material containing bound hydrogen atoms is pyrolyzed in the presence of a beneficially reactive gas and a heated carbon containing particulate solid source of heat under conditions of time and elevated temperature sufficient to pyrolyze the solid particulate carbonaceous feed material. The pyrolysis products comprise particulate solids and a gaseous mixture. The particulate solids comprise a carbon-containing solid residue produced from the solid particulate carbonaceous feed material. The gaseous mixture comprises pyrolytic product vapors produced from the solid particulate carbonaceous feed material, and the beneficially reactive gas and gaseous products produced therefrom. The pyrolytic product vapors comprise hydrocarbons which comprise newly formed volatilized hydrocarbon free radicals. At least a portion of the hydrocarbons comprise four or more carbon atoms.

The particulate solids are separated from the gaseous mixture to form a substantially solids-free gaseous mixture stream which is then immediately contacted with a quench fluid which comprises at least one capping agent capable of stabilizing newly formed volatilized hydrocarbon free radicals contained in the gaseous mixture stream. Such free radicals are stabilized by the transfer of hydrogen from the capping agent to the free radicals thereby forming stabilized radicals and a hydrogen depleted capping agent. At least a major portion of the volatilized hydrocarbon free radicals contained in the gaseous mixture stream are stabilized and at least a major portion of the hydrocarbon vapors having four or more carbon atoms in the gaseous mixture stream are condensed. A gaseous residue and a liquid mixture are then formed. The liquid mixture comprises a hydrocarbon condensate, the quench fluid, a portion of the capping agent, and a hydrogen depleted capping agent. Values are recovered from the gaseous residue. Condensed stabilized hydrocarbons are recovered from the liquid mixture.

This invention therefore relates to a process for recovery of condensed stabilized hydrocarbons produced by flash pyrolysis of solid particulate carbonaceous feed materials and, more particularly, to a process for terminating free radicals by quenching with a capping agent, or a fluid containing a capping agent, a pyrolytic vapor mixture removed from a transport flash pyrolysis reactor.

In practicing this invention, a solid particulate carbonaceous feed material containing bound hydrogen atoms, a beneficially reactive transport gas, and a solid particulate source of heat are fed to a transport flash pyrolysis reactor for pyrolyzing the solid particulate carbonaceous feed material. A pyrolysis product stream is formed which contains particulate solids and a gaseous mixture comprising pyrolytic product vapors which comprise hydrocarbons. The hydrocarbons formed include larger hydrocarbons having four or more carbon atoms. The hydrocarbons formed also include volatilized hydrocarbon free radicals including volatilized hydrocarbon free radicals having four or more carbon atoms. The pyrolysis product stream passes from the pyrolysis reactor to a separation zone where at least a major portion of the particulate solids are separated from the gaseous mixture, to form a substantially solids-free gaseous mixture stream.

A portion of the separated particulate solids is recovered as char product and a remainder is recycled, after heating, to the transport flash pyrolysis reactor as the solid particulate source of heat.

The solids-free gaseous mixture stream is then contacted in a quench zone with a quench fluid which comprises at least one capping agent for terminating or stabilizing at least a major portion of the newly formed hydrocarbon free radicals contained in the gaseous mixture stream. While we do not wish to be bound by theory, the capping agent terminates, i.e., stabilizes the newly formed hydrocarbon free radicals by providing active hydrogen atoms to react with and terminate the free radicals. In one embodiment the capping agent is added initially to the system and is regenerated by the process. Make-up capping agent can be added if required. In another embodiment the process produces a capping agent in the hydrocarbon product stream. In either case, the quench fluid is provided under conditions sufficient to condense at least a major portion of the hydrocarbon vapors having four or more carbon atoms thereby forming a hydrocarbon condensate and a gaseous residue. The hydrocarbon condensate in admixture with the quench fluid forms a liquid mixture. At least a portion of the capping agent is partially depleted of hydrogen atoms in the quench zone and passes with any unconsumed capping agent in the liquid mixture to a liquid product separation zone for separation and recovery of liquid products.

A neutral tar liquid stream which comprises tar liquids and at least a portion of the capping agent and hydrogen depleted capping agent is separated from the liquid mixture in the liquid product separation zone. In one embodiment at least a portion of the neutral tar liquid stream is hydrogenated to upgrade the tar liquids and to regenerate capping agent from the depleted capping agent so that it is suitable for reuse in the process as a capping agent for terminating hydrocarbon free radicals. In one embodiment the hydrogenated neutral tar liquid stream is utilized as a quench liquid. In another embodiment the regenerated capping agent and any unconsumed capping agent are separated from the hydrogenated neutral tar liquid stream and that combination is recycled as the quench liquid. In the latter embodiment the quench liquid has a higher concentration of capping agent than in the former embodiment.

In still another embodiment at least a portion of the depleted capping agent and any unconsumed capping agent are separated directly from the liquid mixture and hydrogenated to regenerate a capping agent suitable for terminating hydrocarbon free radicals. This stream is then recycled to the quench zone as at least a portion of the quench fluid. In a preferred embodiment, especially after steady state is reached, the capping agent is principally a liquid produced by the pyrolysis process.

Capping agents useful in accordance with the practice of this invention include hydrogen donor solvents, hydrogen transferring or shuttling agents, and/or free radical trapping agents, mixtures thereof and the like.

Hydrogen donor solvents are those solvents which can donate hydrogen to tar free radicals to prevent recombination or polymerization of tar liquids by free radical mechanisms in the vapor or liquid state. Examples of hydrogen donor solvents are hydroaromatic compounds, such as tetrahydronaphthalene, dihydronaphthalene, partially hydrogenated phenanthrenes, partially hydrogenated anthracenes, alkyl substituted compounds of the above, mixtures thereof, and the like, which comprise multi-ring structures wherein one of the rings is aromatic. Also useful as hydrogen donor solvents are fully saturated aromatic compounds or alicyclics, such as decahydronaphthalene, perhydroanthracene, perhydrophenanthrene, or alkyl substituted compounds of the above, or mixtures thereof or the like. Hydroaromatic compounds are preferred capping agents with tetrahydronaphthalene being especially preferred.

Hydrogen transferring or shuttling agents do not have donatable hydrogen but can accept hydrogen from other sources and transfer the hydrogen to the hydrocarbon free radicals. Examples of hydrogen transferring or shuttling agents are naphthalene, anthracene, creosote oil, and the like.

Capping agents can also be free radical trapping agents, such as thiols, phenols, amines, and the like which can act either as hydrogen donor solvents and/or as hydrogen transferring or shuttling agents.

Regardless of the particular capping agent utilized, the quench liquid preferably contains a sufficient amount of the capping agent or agents to terminate substantially all of the volatilized hydrocarbon free radicals newly formed by pyrolysis and contained in the substantially solids-free gaseous mixture stream. By "substantially all of the volatilized hydrocarbon free radicals", it is meant that at least about 95% and preferably greater than about 99% of the volatilized hydrocarbon free radicals newly formed by pyrolysis and contained in the pyrolytic vapor stream are terminated.

In carbonaceous materials such as coal or the like there are many large and relatively stable free radicals initially present before pyrolysis which, it is believed, are not terminated in the process. These radicals, of course, are not newly formed and are believed to be large free radicals that have multiple ring structures, having unpaired electrons which are highly stabilized by resonance and therefore are less reactive with capping agents. Steric hindrance factors in such large radicals can also retard the free radical-capping agent interaction.

As the percentage of volatilized hydrocarbon free radicals that are terminated increases, the average molecular weight of the tar liquid products decreases, providing for a higher yield of the desirable lower molecular weight tar liquids. It takes one reactive hydrogen atom to stabilize each volatilized hydrocarbon free radical produced, for example, tetrahydronaphthalene can donate four hydrogen atoms for capping or terminating four volatilized hydrocarbon free radicals. In one embodiment, at least a molar amount of tetrahydronaphthalene is utilized in the quench fluid which is equal to one fourth the number of moles of newly formed hydrocarbon free radicals. In a preferred embodiment excess capping agent is used.

The quench liquid containing capping agent is introduced at a temperature and at a flow rate which will provide for condensation of at least a major portion and preferably substantially all of the vaporized hydrocarbons having four or more carbon atoms. By "substantially all of the vaporized hydrocarbons having four or more carbon atoms", it is meant that at least about 95% and preferably greater than about 99% of the vaporized hydrocarbons having four or more carbon atoms in the gaseous mixture stream are condensed by direct heat exchange with the quench fluid.

Temperature reduction of the pyrolytic vapors should also be sufficiently rapid to hinder recombination of desirable lighter hydrocarbon molecules into less desirable heavier molecules. Generally, the temperature of the product vapor can be reduced sufficiently rapidly by using a ratio of about 0.1 to about 100 pounds of quench liquid per pound of substantially solids-free vapor mixture. Preferably the ratio is from about 1 to about 10 pounds of quench liquid per pound of vapor mixture.

The temperature of the substantially particulate solids-free gaseous mixture stream is usually in the range of the desired pyrolysis temperature, i.e., from about 1100° to about 1400° F. It has been found desirable to provide the quench liquid at a temperature and flow rate sufficient for rapidly reducing the temperature of the gaseous mixture to less than about 700° F., preferably to less than about 200° F. for substantially eliminating recombination of lighter hydrocarbon molecules.

The solid carbonaceous material from which values may be recovered in accordance with this invention include coals, gilsonite, tar sands, oil shale, oil from oil shale, the organic portion of solid waste and the like. Since the process is especially useful for coals, the process will be described for the processing of coals and particularly agglomerative coals. All the various types of coal or coal-like substances can be pyrolyzed. Coals include anthracite coal, bituminous coal, subbituminous coal, lignite, peat, and the like.

BRIEF DESCRIPTION OF THE DRAWINGS

These and other features and advantages of the present invention will become better understood with reference to the following description, accompanying drawings and appended claims.

BEST MODE FOR CARRYING OUT THE INVENTION

Figure 1:
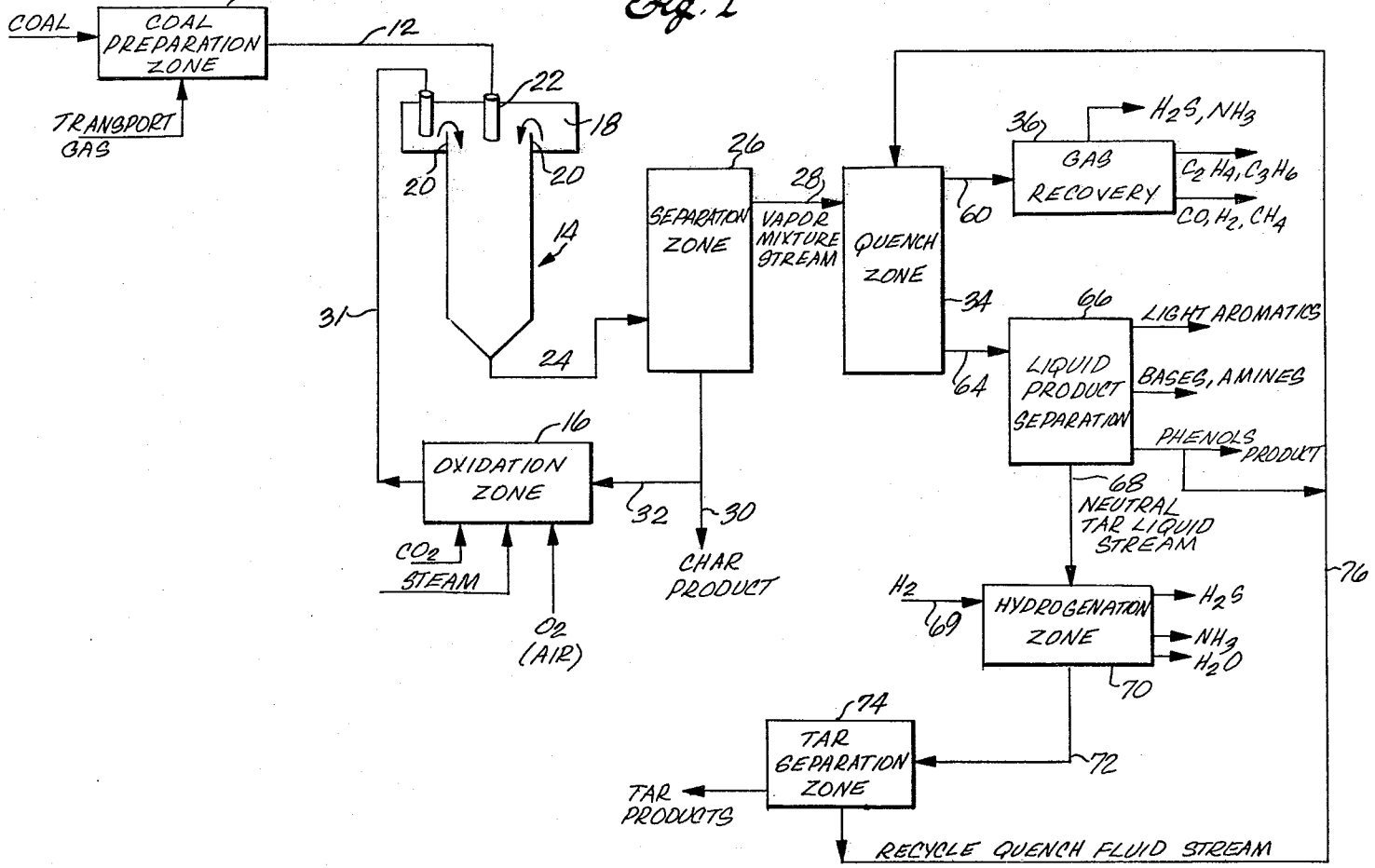
FIG. 1 schematically illustrates the overall process of the invention.

With reference now to FIG. 1, the coal to be pyrolyzed is introduced into a coal preparation zone 10 where it is initially comminuted to a suitable particle size for pyrolysis. A suitable particle size has been found to be less than about 1000 microns.

When an agglomerative coal is used, preferably the particle size is less than about 250 microns to enable the coal to be rapidly heated through the plastic state of the coal before the coal strikes the walls of a pyrolysis reactor in order to prevent the coal from agglomerating and plugging the reactor. The desired coal particle size will depend on the size and configuration of the pyrolysis reactor. In all cases, however, it is desired that a particle size be chosen so that substantially all the coal particles are rendered non-tacky before they strike the reactor wall as described in U.S. Pat. No. 4,135,982 which is incorporated herein by reference.

In general the coal is preferably comminuted to as small a size as practical for facilitating its rapid heating in the pyrolysis reactor. However, it is important to minimize the production of fines, e.g., particles having a size less than about 10 microns, in order to facilitate subsequent gas-solid separation operations as described later herein. Fines which are produced can be removed in a cyclone separation zone (not shown) designed for separation of the fines smaller than a predetermined particle size. Fine removal minimizes particle carryover and contamination of pyrolysis liquid products.

The coal can be fully dried or preferably only partially dried thereby allowing steam to be produced in the pyrolysis zone which serves to inhibit active sites on char solids, as will be explained further below. It has been found that a high hydrocarbon product yield is obtained by leaving about 15% by weight water in subbituminous coal feeds. The coal can be dried fully or partially with flue gas, or effluent gas from a flare, or the like. Additional details of the preparation of coal for pyrolysis can be found in U.S. Pat. No. 4,145,274 which is incorporated herein by reference.

The comminuted coal is combined with a beneficially reactive carrier or transport gas and is passed through line 12 to transport pyrolysis reactor 14. By a "beneficially reactive carrier or transport gas", is meant a gas substantially free of free oxygen, and which contains gaseous constituents which inhibit the reactivity of the char product and the carbon containing particulate solid source of heat so as to decrease the cracking and polymerization of the pyrolytic product vapors and thereby upgrading product quality. In one embodiment recycle product gas is used as the carrier gas. In one embodiment the beneficially reactive carrier gas may also contain carbon dioxide and/or steam as char deactivators.

The solid particulate carbonaceous feed material is combined, in pyrolysis reactor 14, with a solid particulate source of heat which is preferably a portion of the solid residue of pyrolysis or char heated in oxidation zone 16 by partial oxidation to a temperature sufficient for direct use as a solid particulate source of heat in pyrolysis reactor 14. Pyrolysis reactor 14 is operated under turbulent flow conditions at temperatures from about 600° to about 2000° F. at residence times of less than about 5 seconds and preferably from about 0.1 to about 3 seconds to maximize the yield of volatilized hydrocarbons. Longer residence times at lower pyrolysis temperatures are preferred because cracking of volatile pyrolysis vapors is minimized while the desired degree of devolatilization is still achieved. To effect pyrolysis, the weight ratio of the solid particulate source of heat to the solid particulate carbonaceous feed material will range from about 2:1 to about 40:1. These weight ratios require the temperature of the solid particulate source of heat to be about 25° to about 500° F. higher than the pyrolysis zone temperature. Pyrolysis operations to which this invention is adapted are described in U.S. Pat. Nos. 3,736,233 and 4,085,030 each of which is incorporated herein by reference as well as earlier mentioned U.S. Pat. No. 4,145,274.

The coal or solid particulate carbonaceous feed material, the beneficially reactive transport gas, and the solid particulate source of heat are combined under turbulent flow conditions in pyrolysis reactor 14. As shown in FIG. 1, reactor 14 is preferably a substantially vertically oriented descending flow transport pyrolysis reactor in which the solid particulate source of heat enters a substantially vertically oriented annular fluidization chamber 18 which surrounds the upper portion of a substantially vertically oriented descending flow pyrolysis reactor 14. The fluidization chamber has an inner peripheral wall 20 which forms an overflow weir to a substantially vertically oriented mixing region of the pyrolysis reactor. The solid particulate source of heat is maintained in the fluidization chamber in a fluidized state by the flow of a beneficially reactive fluidizing gas so that the solid particulate source of heat is discharged over the weir and downwardly into the vertically oriented mixing region at a rate sufficient to maintain the pyrolysis reaction zone at the pyrolysis temperature.

The solid particulate carbonaceous feed material or coal feed and a beneficially reactive transport gas are injected from a solids feed inlet 22 into the vertically oriented mixing region and form a resultant turbulent mixture of the solid particulate source of heat, the solid particulate carbonaceous feed material or coal, and the beneficially reactive transport gas. The resultant turbulent mixture is passed downwardly from the mixing region to a pyrolysis reaction zone within the transport pyrolysis reactor in which the solid particulate carbonaceous feed material or coal is pyrolyzed. Pyrolysis product stream 24 contains as particulate solids, the solid particulate source of heat and a carbon-containing solid residue of pyrolysis; and a gaseous mixture comprising the unreacted beneficially reactive transport gas, a gaseous product formed from the reaction of the beneficially reactive transport gas and the pyrolysis products and char, and pyrolytic product vapors which comprise hydrocarbons some of which have four or more carbon atoms and newly formed volatilized hydrocarbon free radicals.

The reactor described herein is especially adaptive to agglomerative coal as it permits the coal to pass through its plastic state before striking the reactor walls. Such a transport pyrolysis reactor is known as an entrained bed or transport reactor wherein the velocity of the transport gas, the solid particulate source of heat, and the solid particulate carbonaceous feed material are essentially the same and in the same direction.

Pyrolysis product stream 24 from pyrolysis reactor 14 is introduced into a separation zone 26. In separation zone 26, which can comprise cyclone separators or the like, at least a major portion of the solids are separated from the gas-solid mixture to form a substantially solids-free gaseous mixture stream 28. It is desirable to separate substantially all, i.e., about 99% or higher, of the solids from the gas-solid mixture to form the substantially solids-free gaseous mixture stream. Removing substantially all of the solids from the gas-solid mixture provides a gaseous mixture stream which can be handled in various downstream equipments without fouling or plugging.

A portion of the carbon-containing solid residue and spent solid particulate source of heat is withdrawn from separation zone 26 and conveyed in conduit 32 to oxidation zone 16 for partial oxidation with a source of oxygen, such as air, to produce a solid particulate source of heat and a combustion gas. Another portion of the separated solids is withdrawn as product char in stream 30. The flue gas from the oxidation zone 16 contains oxidation products of the char such as carbon monoxide, carbon dioxide, water vapor and sulfur dioxide. In this embodiment, oxidation of the char, which is exothermic, generates essentially all of the heat required for pyrolysis of the coal. Other means of heating can be used however.

The hot particulate char is then separated from the combustion gas by means (not shown) such as one or more centrifugal separation stages in series. Preferably, oxidation zone 16 is a cyclone oxidation-separation reactor designed so that the char can be both heated and separated from the gaseous combustion products in a single unit with attendant savings in capital and operating costs.

The separated, heated char particles can then be reacted with steam or with a mixture of steam and carbon dioxide to form hydrogen gas according to the following reactions:

$$C+H_2O \rightarrow CO+H_2 \quad (1)$$

$$C+CO_2 \rightarrow 2CO \quad (2)$$

$$CO+H_2O \rightarrow CO_2+H_2 \quad (3)$$

As seen by these reactions, the gas produced comprises hydrogen, carbon monoxide, steam, and some carbon dioxide and is a mixture of water gas and combustion gas. The extent of char gasification to produce hydrogen and carbon monoxide is controlled by the amount of steam used and the temperature and pressure of the hot char steam mixture. The greater the amount of steam used, the greater the amount of hydrogen generated. While we do not wish to be bound by theory, the newly formed hydrogen, or nascent hydrogen, is believed to be very reactive in stabilizing or capping hydrocarbon free radicals, thereby improving the quality of the condensed stabilized hydrocarbons produced by this process; or stated another way, the effectiveness of nascent hydrogen permits the use of a lower hydrogen partial pressure for the same degree of hydrogenation.

The heated char is conveyed in char transport line 31 to pyrolysis reactor 14 and utilized therein as the solid particulate source of heat. In this embodiment oxygen is used instead of air as the combustion gas and the flue gas from the oxidization zone is used as the beneficially reactive transport gas which is also introduced into the pyrolysis reactor.

The substantially solids-free gaseous mixture stream 28 from the separation zone 26 comprises the beneficially reactive transport gas and the gaseous products formed therefrom, and volatilized hydrocarbons. The volatilized hydrocarbons include condensible hydrocarbons having four or more carbon atoms, a portion of which are free radicals. The condensible hydrocarbons are recovered as condensate in quench zone 34 by direct contact wit a quench fluid containing the capping agent to stabilize and terminate the free radicals, including the newly formed free radicals, aided, if desired, by indirect cooling, such as a heat exchanger. In addition, the volatilized hydrocarbons comprise normally non-condensible gases, such as methane and other lower molecular weight hydrocarbon gases which are not recoverable by condensation means which are not very low temperature or cryogenic. These gases are conveyed through conduit 60 to gas recovery zone 36.

The substantially solids-free gaseous mixture stream 28, which comprises newly formed volatilized hydrocarbon free radicals which have not been terminated in the pyrolysis zone, is introduced into the quench zone 34 wherein the newly formed volatilized hydrocarbon free radicals are stabilized and terminated by contacting with a capping agent. Quench zone 34 is a gas-liquid contacting zone and for example can comprise a spray tower, a Venturi contactor, a gas absorption tower, or the like, or combinations thereof.

As indicated, in order to stabilize or terminate free radicals, a quench fluid is provided which consists essentially of hydrocarbons and includes at least one capping agent. In this embodiment, the quench fluid is a hydrogenated neutral tar liquid recovered from the condensate. The quench fluid contains, in this embodiment, at least one regenerative capping agent which is formed during pyrolysis or hydrogenation of liquid pyrolysis products. In another embodiment the capping agent is added initially and when depleted of hydrogen atoms can be regenerated by hydrogenation. In either case it is convenient to add the capping agent at start up. Where the capping agent is produced by the process it can be different than the start-up capping agent in which case the capping agent becomes essentially process produced capping agent after steady state is reached.

The capping agents are hydrogen donor solvents, hydrogen transferring or shuttling agents, and/or free radical trapping agents, mixtures thereof, and the like. The amount of quench fluid, which contains capping agents for terminating substantially all of the free radicals newly formed in pyrolysis and present in the pyrolytic gaseous mixture stream, is sufficient to rapidly cool the gaseous mixture stream and to form a condensate which contains the condensed stabilized hydrocarbons and unconsumed and spent capping agent.

Use of a quench fluid comprising a capping agent causes stabilizing and terminating of tar free radicals of constituents of the treated hydrocarbon vapors and cooling and condensing of a substantial portion of the hydrocarbon vapors having four or more carbon atoms. This process utilizing a quench fluid with a capping agent increases the yield of lower molecular weight tar liquids.

In one preferred embodiment a multiple stage quench is used rather than a single stage quench. The advantage of a multiple stage quench is that during pressure upsets or other malfunctions, solids which enter the quench zone can be handled without rendering the quench recirculation system inoperative as is likely to result if only a single stage is used. A two stage quench provides enough system flexibility and time to take corrective action by automatic or manual control procedures. For example in one embodiment the first quench stage is designed so as not to plug with mixtures containing entrained particulates by providing a quench fluid flow rate sufficient to simultaneously scrub and flush out any entrained particulates. This is an important embodiment because the higher molecular weight viscous tars when condensed are sticky and will form an agglomerative mass with any entrained particulates. Examples of a suitable first stage are non-plugging means such as spray wash towers or loose packed towers. However, a wash tower or loosed packed tower which is satisfactory for a first stage generally is not efficient by itself as a scrubbing device when high volatile coal is rapidly pyrolyzed with substantial amounts of transport gas as used in the coal pyrolysis process described herein because entrained liquids and aerosols are generally found in the first quench stage effluent. A second stage contacting means therefore is needed to separate and recover any entrained liquids and aerosols. The second stage must have a higher contacting efficiency than normally available in a wash tower. A high efficiency Venturi scrubber is an example of a suitable second stage contactor. A two stage quench system, consisting of a wash tower as a first stage followed by a Venturi scrubber as a second stage, has been found to be effective. The wash tower first stage provides for most of the free radical termination, temperature reduction and removal of the bulk of any entrained solids. The Venturi second stage effectively collects the remainder of the entrained liquids and aerosols.

Figure 2:
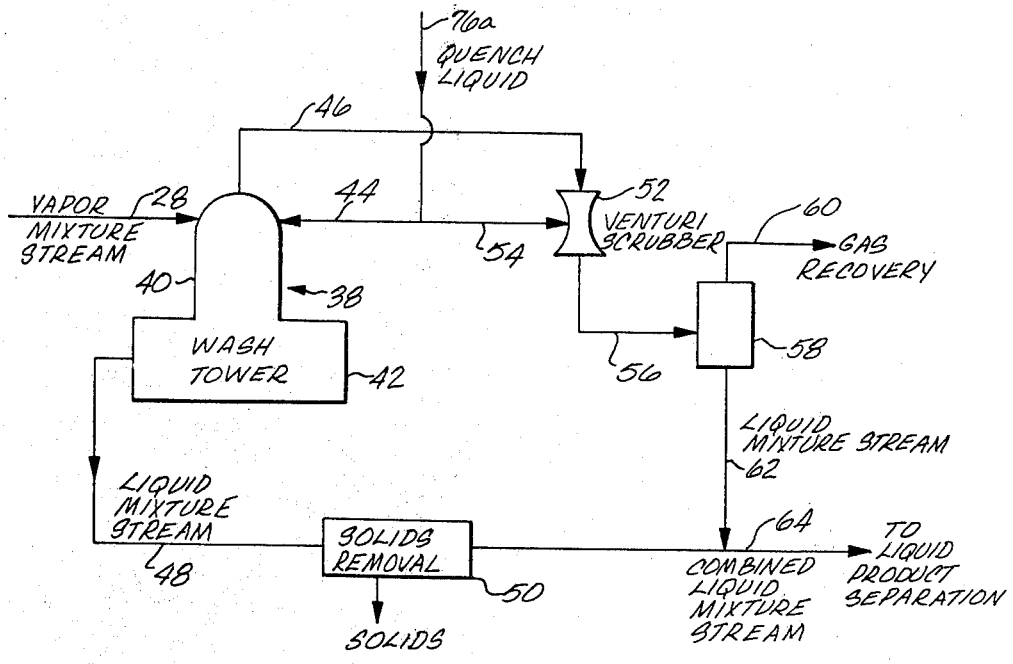
FIG. 2 schematically illustrates the operation of a quench zone.

Referring now to FIG. 2, a preferred system includes wash tower 38 as a first quench stage, having a condensation section 40 and a liquid collection section 42. A first quench fluid stream 44 comprising a capping agent, provided in an amount sufficient for stabilizing and terminating substantially all of the newly formed hydrocarbon free radicals contained in the substantially solids-free gaseous mixture stream, is introduced into the condensation section 40 of the wash tower. The substantially solids-free gaseous mixture stream 28 of FIG. 1 comprising volatilized hydrocarbons having four or more carbon atoms and volatilized hydrocarbon free radicals is also introduced into the condensation section 40. The first quench fluid stream 44 contacts the substantially solids-free gaseous mixture stream 28 in the condensation section, thereby stabilizing and terminating the vaporized free radicals and condensing at least a major portion of the larger hydrocarbons which contain four or more carbon atoms per molecule in the gaseous mixture stream. Preferably the first quench fluid stream is introduced into the quench zone at a temperature and at a flow rate sufficient to reduce the temperature of the substantially solids-free gaseous stream to less than about 700° F. and especially preferably to less than about 200° F. A condensate is formed which comprises the stabilized and terminated hydrocarbon free radicals. A gaseous residue stream 46 then remains which comprises those portions of the gaseous mixture stream 28, such as non-condensible gases, lighter hydrocarbons, which have not condensed, the lighter molecular weight portion of the quench fluid which has been vaporized and entrained liquids, and aerosols. The condensate and the bulk of the first quench fluid flow down into liquid collection section 42 of wash tower 38 and combine to form a first liquid mixture. Any remaining tar free radicals that were not terminated in the gaseous state but were condensed will be terminated by contact with the capping agent in the quench fluid in liquid collection section 42. The liquid mixture containing the condensate is removed from the wash tower and conveyed in conduit 48 to a solids removal zone 50.

A residual gaseous residue stream is removed from the top portion of the condensation section of the wash tower and conveyed in conduit 46 to Venturi scrubber 52. A second portion of the quench fluid stream is introduced into the Venturi scrubber through conduit 54 and contacts the residual gaseous residue stream 46 to terminate any remaining volatilized hydrocarbon free radicals and to scrub entrained hydrocarbons in the form of aerosols or vapors from the gaseous residue stream. The scrubbed gaseous residue stream and the second portion of the quench fluid are combined and removed from the Venturi scrubber through conduit 56. The remaining gas phase is separated from the liquids by introducing stream 56 into separator vessel 58. The separated gas is removed through conduit 60.

The second portion of the quench fluid and the separated entrained tars are removed from separator vessel 58 as a liquid mixture in conduit 62 and combined with the liquid mixture in stream 48 to form a combined liquid mixture in stream 64. Combined liquid mixture stream 64 is conveyed to liquid product separation zone 66 of FIG. 1.

A portion of the volatilized hydrocarbons produced by pyrolysis of coal comprise heavy tars having boiling points above the boiling points of middle distillate tar liquids. These heavy viscous tars have a high carbon-hydrogen atomic ratio and frequently contain heterocyclic compounds such as organic sulfur and nitrogen compounds. By hydrogenating volatilized hydrocarbons in the pyrolysis reaction zone using hydrogen gas, the value of the volatilized hydrocarbons can be increased by sulfur and nitrogen removal as hydrogen sulfide and ammonia. Vapor phase hydrogenation with hydrogen directly in the pyrolysis reactor will reduce the viscosity and lower the average boiling point of the volatilized hydrocarbons by terminating some free radicals, but hydrogenation at pyrolysis temperatures is not as effective in stabilizing and terminating volatilized free radicals as contacting with a quench fluid containing a capping agent as described herein. Nevertheless, since some free radicals can be terminated in the pyrolysis zone by hydrogenation, in this embodiment, the gas produced in oxidation zone 16 which comprises hydrogen is introduced into pyrolysis reactor 14 along with the solid particulate source of heat to terminate at least a portion of the free radicals directly in the pyrolysis zone by hydrogen reaction. In another embodiment a hydrogen containing gas stream can be fed separately into the pyrolysis reactor for this purpose.

The pyrolysis reaction zone is preferably operated at pressures slightly greater than ambient, although pressures up to about 10,000 psig may also be used. An increase in pressure increases the hydrogen partial pressure in the pyrolysis zone and increases the hydrogenation of the volatilized hydrocarbons. However, as the pressure in the pyrolysis reaction zone increases, the capital and operating costs of the process also increase. Therefore, the preferred operating pressure range for the pyrolysis reaction zone for economical reasons is from about 1 psig to about 1000 psig.

It is known that the char produced by rapid heating of coal, as in pyrolysis, is very porous, has a large or open pore volume, and a high surface area. These characteristics result in a higher char reactivity than chars produced by slow heating. High reactivity of these chars is largely attributed to their high internal surface area. The char produced from pyrolysis of coal, as described herein, is also very reactive.

It has been determined that the presence of carbon dioxide and steam in the pyrolysis zone increases the yield of condensible hydrocarbons by neutralizing active sites on the char produced during pyrolysis. Char which has not been so neutralized tends to catalyze the formation of high molecular weight hydrocarbons by promoting polymerization and/or cracking at such active char sites.

While not wishing to be bound by theory, it is believed that the hydrocarbon vapors produced by pyrolysis of coal occupy the reactive sites on the hot char used as a heating medium and are polymerized to heavy tar liquids, char, or coke by free radical mechanisms. This has the result of reducing the yield of middle distillate tar liquids, a desired product. It is also believed that the char reactions with $CO_2$ or steam involve an oxygen transfer step from these gases to the char, followed by a gasification step in which the oxygen-carbon complex is released as CO. These reactions are believed to take place on the reactive sites on the char, and in so doing reduce the availability of these reactive sites for tar adsorption, polymerization, and cracking. Therefore, hydrogen, steam, carbon dioxide, or mixtures thereof introduced into the pyrolysis zone as a beneficially reactive gas, or used as a beneficially reactive carrier gas for hot char, in combination with a subsequent capping agent quench, immediately after pyrolysis increases the yield of lower molecular weight hydrocarbons, decreases the average molecular weight of condensible liquid product, and minimizes hydrocarbon yield loss.

Referring again to FIG. 1, combined liquid mixture stream 64, which comprises the liquid mixture from the first stage of the quench zone and the liquid mixture from the second stage of the quench zone, is sent to a liquid product separation zone 66.

In the embodiment shown in FIG. 1, which is particularly useful when the feed coal or solid carbonaceous feed material has a high oxygen and nitrogen content, at least several liquid hydrocarbon fractions are recovered from the combined liquid mixture stream in liquid product separation zone 66. These fractions are the light low boiling hydrocarbon fraction comprising $C_4$'s to $C_8$'s, tar acids comprising phenols, tar bases comprising amines, and a neutral tar liquid fraction comprising $C_9$'s and higher and the heavy tar product.

The neutral tar liquid fraction comprises hydrocarbon liquids which comprise consumed and unconsumed capping agents from the quench zone 34. The neutral tar liquid fraction can be upgraded by hydrogenation. A fluidized or fixed bed hydrogenation process is useful for this purpose. A suitable hydrogenation process comprises hydrogenating at least a portion of the neutral tar liquid stream to produce a hydrogenated neutral tar liquid stream comprising a regenerated capping agent capable of terminating free radicals. The hydrogenation process in the embodiment shown in FIG. 1 involves the removal of contaminants, such as sulfur as hydrogen sulfide and nitrogen as ammonia, from the liquid, thereby resulting in a more environmentally attractive fuel product. Water is also removed. Conventional processes may be employed for these removal steps. This embodiment will enhance the chemical stability of the product and form products with improved handling and storage characteristics. In another embodiment at least a portion of the liquids are hydrocracked to form lower molecular weight hydrocarbons suitable for use in such products as gasoline.

Suitable hydrogenation conditions are a hydrogenation temperature from about 700° to about 900° F., hydrogen partial pressures of from about 1000 to about 3000 psia, a hydrogen volume between about 1000 to about 5000 standard cubic feet per barrel of feed of neutral tar liquid to be treated, and an amount of catalyst of from about 0.2 to about 3 volumes of neutral tar liquid per hour per volume of catalyst. Suitable hydrogenation catalysts are for example metals in the sulfide form, such as nickel, molybdenum, tungsten, and cobalt which can be supported on alumina or silica-aluminum base. Hydrogenation can also be conducted at elevated temperatures and pressures in the absence of a catalyst.

As shown in FIG. 1, neutral tar liquid stream 68 is introduced into hydrogenation zone 70 and contacted with a stream of hydrogen gas introduced into the hydrogenation zone through conduit 69. The hydrogenated neutral tar liquids thusly produced are then conveyed through conduit 72 to tar separation zone 74. The hydrogenated neutral tar liquids are separated by conventional distillation processes in the tar separation zone 74 into at least a hydrogenated tar product fraction comprising hydrogenated heavy tars and a hydrogenated liquid fraction comprising regenerated capping agent and any unconsumed capping agent. At least a portion of the hydrogenated liquid fraction is utilized as quench fluid stream 76 to quench zone 34. It is preferred that the liquid separations are conducted so that the recycle quench fluid stream comprises tar liquids having a boiling point range between about 350° and about 650° F.

In still another embodiment of this invention, at least a portion of the consumed capping agent, i.e. the hydrogen depleted capping agent, and any unconsumed capping agent, are separated directly from the combined liquid mixture stream. The mixture of hydrogen depleted and unconsumed capping agent is then hydrogenated to form a regenerated capping agent mixture at least a portion of which is then recycled to the quench zone as the quench fluid.

In an alternate embodiment at least a portion of the unconsumed and consumed capping agent are separated from the neutral tar liquid stream prior to hydrogenation of the neutral tar liquid stream. The consumed and unconsumed capping agent mixture is then hydrogenated separately to form a regenerated capping agent mixture at least a portion of which is recycled to the quench zone as the quench fluid.

In the embodiment shown in FIG. 2, recycle quench fluid stream 76 is split to form quench fluid stream 44 and quench fluid stream 54. It is to be understood that stream 44 and 54 do not have to be identical in chemical composition and can be tailored to the duty required of each quench zone.

At least a portion of the phenols from liquid product separation zone 66, FIG. 1, can, if desired, be added to the quench fluid as additional capping agent for enhancing the free radical termination ability of the quench fluid. Phenols are good solvents for tar liquids and will improve the miscibility of hydrocarbon condensate in combined liquid mixture stream 64. Since phenols are also capping agents their inclusion in the quench fluid will improve hydrocarbon free radical termination capability of the quench fluid.

At least a portion of the heavier tar liquid products having a boiling point of from above about 650° to about 950° F. can be recycled back to the pyrolysis zone for further cracking if desired, or blended with light oil to produce a fuel oil.

The remainder of gaseous residue stream is removed from quench zone 34 through conduit 60 and introduced into gas recovery zone 36 for recovery of light hydrocarbons such as methane, butane, propane, and other low molecular weight hydrocarbons. Preferably sulfur and nitrogen compounds are also removed enabling recovery of hydrogen, hydrogen sulfide, ammonia, and the like. For example gas recovery zone 36 can be a conventional acid gas removal unit where the hydrogen sulfide is separated and removed. After removal of the hydrogen sulfide, the remaining gas can be compressed and utilized in coal preparation operations or as a beneficially reactive transport gas. Any surplus gas can be used as a fuel gas, or as a feed gas for conversion to pipeline quality natural gas or ammonia. The hydrogen sulfide-rich stream from the acid gas removal unit can be sent to a Claus unit for sulfur recovery.

EXAMPLE

The following example demonstrates the utility of this invention.

Figure 3:
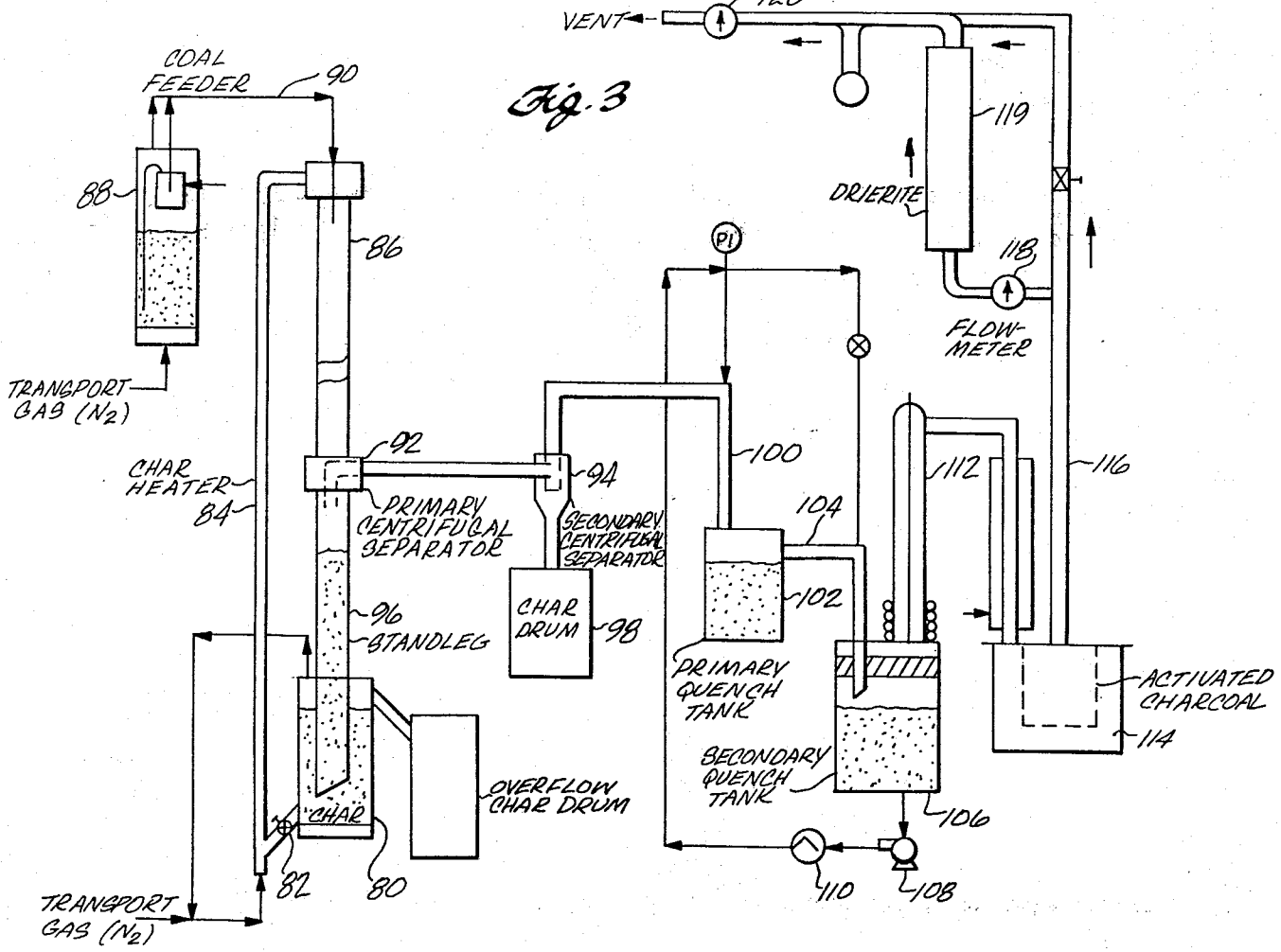
FIG. 3 is a flow sheet of a unit used to demonstrate features of this invention.

The pyrolysis unit shown in FIG. 3 comprises a fluidized char feeder 80 for feeding char through char feed valve 82 to char heater 84. The external wall of char heater 84 is heated by electrical heating elements. Char feeder 80 is also used as a receiver vessel for product char.

Wyoming subbituminous coal is fed to the pyrolysis reactor 86 at a rate of about 3 lb/hr using fluidized coal feeder 88. An equal molar mixture of steam and carbon dioxide, as a beneficially reactive transport gas, is fed to the coal feeder at a flow rate of about 0.3 SCFM (standard cubic feet per minute) to fluidize and transport the coal through coal transport line 90 and into pyrolysis reactor 86. Additional transport gas of the same composition is introduced into char heater 84 at a flow rate of 2.7 SCFM to convey the hot char into the pyrolysis reactor. The external wall of the reactor is heated by electrical heating elements, which in conjunction with the heated char causes the coal to be heated to about 1200° F. thereby effecting pyrolysis of the coal. A product stream comprising hydrocarbon vapors and solids, is treated in series connected primary centrifugal separator 92 and secondary centrifugal separator 94 to separate solids from gases. Separated solids from the primary separator are dropped into a stand leg 96 and then into char feeder 80. Solids separated by secondary separator 94 are collected in char drum 98.

Hot gases from the secondary separator are conveyed to quench scrubber 100 and are contacted therein with tetrahydronaphthalene as a capping agent and quench fluid. At least a portion of the pyrolytic product vapors are condensed as liquid product and collected along with the quench liquid in primary quench tank 102. Hot pyrolytic product vapors which are not condensed in quench scrubber 100 and uncondensed gas, containing $CH_4$, $CO_2$, $H_2$, $C_2H_4$, and CO flow from primary quench tank 102 to secondary quench scrubber 104 where it is contacted with more quench fluid. Condensate and quench fluid are collected in secondary quench tank 106. Quench liquid flow rates to the primary and secondary scrubbers are maintained at about 10 gph (gallons per hour) each. The quench fluid temperature is about 30° to about 40° F. Liquid is pumped out of the bottom of secondary quench tank 106 by pump 108, then through heat exchanger 110, and then into both the primary and secondary quench scrubbers.

The cooled gases and any condensate in the form of an aerosol are passed from the top of secondary quench tank 106 to electrostatic precipitator 112 which separates and recovers the aerosols. The remaining cooled gas at a temperature of about 50° to about 80° F. is then passed through activated charcoal bed 114 to remove remaining trace amounts of light hydrocarbons. The cooled gas then is passed from activated charcoal bed 114 through the vent line 116, flow meter 118, drierite bed 119 for removal of water vapor, and lastly through flow meter 120 before venting to the atmosphere.

A second test is conducted using a bench scale unit similar to the bench scale unit of FIG. 3. In the second test, the vapors from the flash pyrolysis unit described in U.S. Pat. No. 4,162,959, are cooled and condensed using indirect cooling, i.e., heat exchangers, rather than by cooling directly with a quench liquid comprising a capping agent as in the first described test.

The advantage of this invention is that by using a beneficially reactive gas in the pyrolysis zone to inhibit the reactivity of the char therein in combination with using a quench liquid comprising a capping agent to quench the pyrolysis vapor product, a hydrocarbon liquid product is produced having a lower average molecular weight than the hydrocarbon liquid product recovered when pyrolysis is conducted in the absence of a beneficially reactive gas in the pyrolysis zone.

Although this invention has been described in considerable detail with reference to certain embodiments thereof, it will be understood that variations and modifications can be effected within the spirit and scope of this invention as described above and defined in the appended claims.

What is claimed is:

1. A process for producing condensed stabilized hydrocarbons from a solid particulate carbonaceous material comprising:

(a) pyrolyzing a solid particulate carbonaceous feed material at a pyrolysis temperature by introducing said solid particulate carbonaceous feed material, a carbon containing particulate solid source of heat which has been heated to a temperature higher than said pyrolysis temperature, and a beneficially reactive gas into a pyrolysis zone, under turbulent flow conditions, and under conditions of time and elevated temperature sufficient to produce therefrom a pyrolysis product comprising particulate solids and pyrolytic product vapors which comprise hydrocarbons which comprise newly formed volatilized hydrocarbon free radicals, a portion of said hydrocarbons containing larger hydrocarbons, said larger hydrocarbons being all the hydrocarbon vapors in said pyrolytic product vapors containing four or more carbon atoms, said particulate solids comprising a char product produced from said solid particulate carbonaceous feed material and said carbon containing particulate solid source of heat, said beneficially reactive gas reducing the polymerizing or cracking of said pyrolytic product vapors by inhibiting the reactivity of said char product and said carbon containing particulate solid source of heat;

(b) separating said particulate solids from a gaseous mixture which comprises said pyrolytic product vapors, said beneficially reactive gas, and any other gases which are mixed therewith to form a substantially solids-free gaseous mixture stream;

(c) contacting said substantially solids-free gaseous mixture stream with a quench fluid comprising a capping agent suitable for stabilizing said newly formed volatilized hydrocarbon free radicals, under predetermined conditions of temperature and flow rate of capping agent sufficient for substantially simultaneously stabilizing substantially all of said newly formed volatilized hydrocarbon free radicals by termination, and substantially simultaneously condensing at least a major portion of said larger hydrocarbons, thereby forming a gaseous residue and condensed stabilized hydrocarbons; and (d) separating at least a portion of said condensed stabilized hydrocarbons thusly formed from said gaseous residue.

2. A continuous process for producing condensed stabilized hydrocarbons from a solid particulate carbonaceous material comprising:

(a) pyrolyzing a solid particulate carbonaceous feed material at a pyrolysis temperature by introducing said solid particulate carbonaceous feed material, a carbon containing particulate solid source of heat which has been heated to a temperature higher than said pyrolysis temperature, and a beneficially reactive gas into a pyrolysis zone, under turbulent flow conditions, and under conditions of time and elevated temperature sufficient to produce therefrom a pyrolysis product comprising particulate solids and pyrolytic product vapors which comprise hydrocarbons which comprise newly formed volatilized hydrocarbon free radicals, a portion of said hydrocarbons containing larger hydrocarbons, said larger hydrocarbons being all the hydrocarbon vapors in said pyrolytic product vapors containing four or more carbon atoms, said particulate solids comprising a char product produced from said solid particulate carbonaceous feed material and said carbon containing particulate solid source of heat, said beneficially reactive gas reducing the polymerizing or cracking or said pyrolytic product vapors by inhibiting the reactivity of said char product and said carbon containing particulate solid source of heat;

(b) separating said particulate solids from a gaseous mixture which comprises said pyrolytic product vapors, said beneficially reactive gas, and any other gases which are mixed therewith to form a substantially solids-free gaseous mixture stream;

(c) contacting said substantially solids-free gaseous mixture stream with a quench fluid comprising a capping agent suitable for stabilizing said newly formed volatilized hydrocarbon free radicals, under predetermined conditions of temperature and flow rate of capping agent sufficient for substantially simultaneously stabilizing substantially all of said newly formed volatilized hydrocarbon free radicals by the transfer of hydrogen from said capping agent to terminate said newly formed volatilized hydrocarbon free radicals, and substantially simultaneously condensing at least a major portion of said larger hydrocarbons, thereby forming a gaseous residue and a liquid mixture comprising condensing stabilized hydrocarbons, and a hydrogen depleted capping agent;

(d) separating said liquid mixture from said gaseous residue;

(e) hydrogenating at least a portion of said liquid mixture, after separation from said gaseous residue, to produce a hydrogenated capping agent suitable for stabilizing said newly formed volatilized hydrocarbon free radicals; and (f) utilizing at least a portion of said hydrogenated capping agent as at least a major portion of said capping agent contained in said quench fluid used for contacting said substantially solids-free gaseous mixture stream.

3. A continuous process for producing condensed stabilized hydrocarbons from a solid particulate carbonaceous material comprising:

(a) pyrolyzing a solid particulate carbonaceous feed material at a pyrolysis temperature by introducing said solid particulate carbonaceous feed material, a carbon containing particulate solid source of heat which has been heated to a temperature higher than said pyrolysis temperature, and a beneficially reactive gas into a pyrolysis zone, under turbulent flow conditions, and under conditions of time and elevated temperature sufficient to produce therefrom a pyrolysis product comprising particulate solids and pyrolytic product vapors which comprise hydrocarbons which comprise newly formed volatilized hydrocarbon free radicals, a portion of said hydrocarbons containing larger hydrocarbons, said larger hydrocarbons being all the hydrocarbon vapors in said pyrolytic product vapors containing four or more carbon atoms, a portion of said hydrocarbons comprising a product agent suitable for use as a capping agent either directly or after hydrotreatment of said product agent, said particulate solids comprising a char product produced from said solid particulate carbonaceous feed material and said carbon containing particulate solid source of heat, said beneficially reactive gas reducing the polymerizing or cracking of said pyrolytic product vapors by inhibiting the reactivity of said char product and said carbon containing particulate solid source of heat;

(b) separating said particulate solids from a gaseous mixture which comprises said pyrolytic product vapors, said beneficially reactive gas, and any other gases which are mixed therewith to form a substantially solids-free gaseous mixture stream;

(c) contacting said substantially solids-free gaseous mixture stream with a quench fluid comprising a capping agent suitable for stabilizing said newly formed volatilized hydrocarbon free radicals, under predetermined conditions of temperature and flow rate of capping agent sufficient for substantially simultaneously stabilizing substantially all of said newly formed volatilized hydrocarbon free radicals by the transfer of hydrogen from said capping agent to said newly formed volatilized hydrocarbon free radicals to terminate such free radicals, and substantially simultaneously condensing at least a major portion of said larger hydrocarbons, thereby forming a gaseous residue and a liquid mixture comprising condensed stabilized hydrocarbons, a hydrogen depleted capping agent, and said product agent;

(d) separating said liquid mixture from said gaseous residue;

(e) hydrogenating at least a portion of said liquid mixture, after separation from said gaseous residue, to produce a hydrogenated capping agent suitable for stabilizing said newly formed volatilized hydrocarbon free radicals, at least a major portion of said hydrogenated capping agent being produced from said product agent; and (f) utilizing at least a portion of said hydrogenated capping agent as at least a major portion of said capping agent contained in said quench fluid used for contacting said substantially solids-free gaseous mixture stream.

4. A continuous process for producing condensed stabilized hydrocarbons from a solid particulate carbonaceous material comprising:

(a) pyrolyzing a solid particulate carbonaceous feed material at a pyrolysis temperature by introducing said solid particulate carbonaceous feed material, a carbon containing particulate solid source of heat which has been heated to a temperature higher than said pyrolysis temperature, and a beneficially reactive gas into a pyrolysis zone, under turbulent flow conditions, and under conditions of time and elevated temperature sufficient to produce therefrom a pyrolysis product comprising particulate solids and pyrolytic product vapors which comprise hydrocarbons which comprise newly formed volatilized hydrocarbon free radicals, a portion of said hydrocarbons containing larger hydrocarbons, said larger hydrocarbons being all the hydrocarbon vapors in said pyrolytic product vapors containing four or more carbon atoms, a portion of said hydrocarbons comprising a product agent suitable for use as a capping agent either directly or after hydrotreatment of said product agent, said particulate solids comprising a char product produced from said solid particulate carbonaceous feed material and said carbon containing particulate solid source of heat, said beneficially reactive gas reducing the polymerizing or cracking of said pyrolytic product vapors by inhibiting the reactivity of said char product and said carbon containing particulate solid source of heat;

(b) separating said particulate solids from a gaseous mixture which comprises said pyrolytic product vapors, said beneficially reactive gas, and any other gases which are mixed therewith to form a substantially solids-free gaseous mixture stream;

(c) contacting said substantially solids-free gaseous mixture stream with a quench fluid comprising a capping agent suitable for stabilizing said newly formed volatilized hydrocarbon free radicals, under predetermined conditions of temperature and flow rate of capping agent sufficient for substantially simultaneously stabilizing substantially all of said newly formed volatilized hydrocarbon free radicals by the transfer of hydrogen from said capping agent to said newly formed volatilized hydrocarbon free radicals to terminate such free radicals, and substantially simultaneously condensing at least a major portion of said larger hydrocarbons, thereby forming a gaseous residue and a liquid mixture comprising condensed stabilized hydrocarbons, a hydrogen depleted capping agent, and said product agent;

(d) separating said liquid mixture from said gaseous residue;

(e) separating said liquid mixture, after separation from said gaseous residue, into at least neutral tar liquids comprising a major portion of said hydrogen depleted capping agent and said product agent, and a residue liquid mixture comprising at least a portion of said condensed stabilized hydrocarbons;

(f) hydrogenating at least a portion of said neutral tar liquids thusly separated to produce hydrogenated neutral tar liquids comprising a hydrogenated capping agent suitable for stabilizing said newly formed volatilized hydrocarbon free radicals, at least a major portion of said hydrogenated capping agent being produced from said product agent;

(g) utilizing at least a portion of said hydrogenated capping agent as at least a major portion of said capping agent contained in said quench fluid used for contacting said substantially solids-free gaseous mixture stream; and (h) recovering at least a portion of said residue liquid mixture.

5. A continuous process for producing condensed stabilized hydrocarbons from a solid particulate carbonaceous material comprising:

(a) pyrolyzing a solid particulate carbonaceous feed material at a pyrolysis temperature by introducing said solid particulate carbonaceous feed material, a carbon containing particulate solid source of heat which has been heated to a temperature higher than said pyrolysis temperature, and a beneficially reactive gas into a pyrolysis zone, under turbulent flow conditions, and under conditions of time and elevated temperature sufficient to produce therefrom a pyrolysis product comprising particulate solids and pyrolytic product vapors which comprise hydrocarbons which comprise newly formed volatilized hydrocarbon free radicals, a portion of said hydrocarbons containing larger hydrocarbons, said larger hydrocarbons being all the hydrocarbon vapors in said pyrolytic product vapors containing four or more carbon atoms, a portion of said hydrocarbons comprising a product agent suitable for use as a capping agent either directly or after hydrotreatment of said product agent, said particulate solids comprising a char product produced from said solid particulate carbonaceous feed material and said carbon containing particulate solid source of heat, said beneficially reactive gas reducing the polymerizing or cracking of said pyrolytic product vapors by inhibiting the reactivity of said char product and said carbon containing particulate solid source of heat;

(b) separating said particulate solids from a gaseous mixture which comprises said pyrolytic product vapors, said beneficially reactive gas, and any other gases which are mixed therewith to form a substantially solids-free gaseous mixture stream;

(c) contacting said substantially solids-free gaseous mixture stream with a quench fluid comprising a capping agent suitable for stabilizing said newly formed volatilized hydrocarbon free radicals, under predetermined conditions of temperature and flow rate of capping agent sufficient for substantially simultaneously stabilizing substantially all of said newly formed volatilized hydrocarbon free radicals by the transfer of hydrogen from said capping agent to said newly formed volatilized hydrocarbon free radicals to terminate such free radicals, and substantially simultaneously condensing at least a major portion of said larger hydrocarbons, thereby forming a gaseous residue and a liquid mixture comprising condensed stabilized hydrocarbons, a hydrogen depleted capping agent, and said product agent;

(d) separating said liquid mixture from said gaseous residue;

(e) separating said liquid mixture, after separation from said gaseous residue, into at least neutral tar liquids and a residue liquid mixture, said neutral tar liquids comprising at least a major portion of said hydrogen depleted capping agent, said product agent, and heavy tars of said liquid mixture, said residue liquid mixture comprising at least a portion of said condensed stabilized hydrocarbons;

(f) hydrogenating at least a portion of said neutral tar liquids thusly separated to produce hydrogenated neutral tar liquids comprising hydrogenated heavy tars and a hydrogenated capping agent suitable for stabilizing said newly formed volatilized hydrocarbon free radicals, at least a major portion of said hydrogenated capping agent being produced from said product agent;

(g) separating said hydrogenated neutral tar liquids thusly separated to produce hydrogenated neutral tar liquids comprising hydrogenated heavy tars and a hydrogenated capping agent suitable for stabilizing said newly formed volatilized hydrocarbon free radicals, at least a major portion of said hydrogenated capping agent being produced from said product agent;

(g) separating said hydrogenated neutral tar liquids into at least a recycle stream comprising at least a major portion of said hydrogenated capping agent, and a heavy tar stream comprising at least a major portion of said hydrogenated heavy tars;

(h) utilizing at least a portion of said recycle stream as at least a major portion of said capping agent contained in said quench fluid used for contacting said substantially solids-free gaseous mixture stream; and (i) recovering at least a portion of said residue liquid mixture and said heavy tar stream.

6. A continuous process for producing condensed stabilized hydrocarbons from a solid particulate carbonaceous material comprising:

(a) pyrolyzing a solid particulate carbonaceous feed material at a pyrolysis temperature by introducing said solid particulate carbonaceous feed material, a carbon containing particulate solid source of heat which has been heated to a temperature higher than said pyrolysis temperature, and a beneficially reactive gas into a pyrolysis zone, under turbulent flow conditions, and under conditions of time and elevated temperature sufficient to produce therefrom a pyrolysis product comprising particulate solids and pyrolytic product vapors which comprise hydrocarbons which comprise newly formed volatilized hydrocarbon free radicals, a portion of said hydrocarbons containing larger hydrocarbons, said larger hydrocarbons being all the hydrocarbon vapors in said pyrolytic product vapors containing four or more carbon atoms, a portion of said hydrocarbons comprising a product agent suitable for use as a capping agent either directly or after hydrotreatment of said product agent, said particulate solids comprising a char product produced from said solid particulate carbonaceous feed material and said carbon containing particulate solid source of heat, said beneficially reactive gas reducing the polymerizing or cracking of said pyrolytic product vapors by inhibiting the reactivity of said char product and said carbon containing particulate solid source of heat;

(b) separating said particulate solids from a gaseous mixture which comprises said pyrolytic product vapors, said beneficially reactive gas, and any other gases which are mised therewith to form a substantially solids-free gaseous mixture stream;

(c) contacting said substantially solids-free gaseous mixture stream with a quench fluid comprising a capping agent suitable for stabilizing said newly formed volatilized hydrocarbon free radicals, under predetermined conditions of temperature and flow rate of capping agent sufficient for substantially simultaneously stabilizing substantially all of said newly formed volatilized hydrocarbon free radicals by the transfer of hydrogen from said capping agent to said newly formed volatilized hydrocarbon free radicals to terminate such free radicals, and substantially simultaneously condensing at least a major portion of said larger hydrocarbons, thereby forming a gaseous residue and a liquid mixture comprising condensed stabilized hydrocarbons, a hydrogen depleted capping agent, and said product agent;

(e) separating said liquid mixture, after separation from said gaseous residue, into at least:
  (i) light aromatics comprising liquids of from about four to about eight carbon atoms per molecule,
  (ii) tar bases comprising amines,
  (iii) tar acids comprising phenols, and
  (iv) neutral tar liquids comprising at least a major portion of said hydrogen depleted capping agent, said product agent, and heavy tars of said liquid mixture;

(f) hydrogenating at least a portion of said neutral tar liquids thusly separated to produce hydrogenated neutral tar liquids comprising a hydrogenated capping agent suitable for stabilizing said newly formed volatilized hydrocarbon free radicals, and hydrogenated heavy tars comprising at least a portion of said condensed stabilized hydrocarbons, at least a major portion of said hydrogenated capping agent being produced from said product agent;

(g) separating said hydrogenated neutral tar liquids into at least a recycle stream comprising at least a major portion of said hydrogenated capping agent, and a heavy tar stream comprising at least a major portion of said hydrogenated heavy tars;

(h) utilizing at least a portion of said recycle stream as at least a major portion of said capping agent contained in said quench fluid used for contacting said substantially solids-free gaseous mixture stream; and (i) recovering at least a portion of said light aromatics, said tar bases, said tar acids and said heavy tar stream.

7. The process of claim 4, 5 or 6 wherein said quench fluid used for contacting said substantially solids-free gaseous mixture stream has a boiling point range between about 350° and about 650° F. for about 90 weight percent of said quench fluid.

8. The process of claim 1, 2, 3, 4, 5 or 6 wherein said solid particulate carbonaceous feed material is selected from the group consisting of coal, agglomerative coal, gilsonite, tar sands, oil shale, oil from oil shale, and the organic portion of solid waste.

9. The process of claim 1, 2, 3, 4, 5 or 6 wherein the amount of said capping agent contained in said quench fluid used for contacting said substantially solids-free gaseous mixture stream is sufficient to terminate 95 percent of said newly formed volatilized hydrocarbon free radicals.

10. The process of claim 1, 2, 3, 4, 5 or 6 wherein the amount of said capping agent contained in said quench fluid used for contacting said substantially solids-free gaseous mixture stream is sufficient to terminate 99 percent of said newly formed volatilized hydrocarbon free radicals.

11. The process of claim 1 or 2 wherein at least a portion of said capping agent is selected from the group consisting of tetrahydronaphthalene, decahydronaphthalene, dihydronaphthalene, hydrogenated phenanthrenes, hydrogenated anthracenes, alkyl substituted tetrahydronaphthalene, alkyl substituted decahydronaphthalene, alkyl substituted dihydronaphthalene, alkyl substituted hydrogenated phenanthrenes, alkyl substituted hydrogenated anthracenes, naphthalene, anthracene, creosote oil, thiols, phenols, amines, and mixtures thereof.

12. The process of claim 6 further comprising adding at least a portion of said tar acids to said quench fluid.

13. The process of claim 6 further comprising separating at least a portion of said phenols from said tar acids and adding at least a portion of said phenols thusly separated to said quench fluid.

14. The process of claim 1, 2, 3, 4, 5 or 6 wherein said contacting of said substantially solids-free gaseous mixture stream is in a quench system comprising a first stage and a second stage, said second stage having a higher contacting efficiency than said first stage.

15. The process of claim 1, 2, 3, 4, 5 or 6 wherein said beneficially reactive gas is introduced into said pyrolysis zone as a carrier gas for said carbon containing particulate solid source of heat.

16. The process of claim 1, 2, 3, 4, 5 or 6 further comprising heating said particulate solids after their separation from said gaseous mixture by partial oxidation to increase their temperature and to produce a flue gas; utilizing at least a portion of said particulate solids thusly heated to a higher temperature as said carbon containing particulate solid source of heat introduced into said pyrolysis zone; and utilizing at least a portion of said flue gas as a carrier gas for introducing said carbon containing particulate solid source of heat into said pyrolysis zone and also as at least a portion of said beneficially reactive gas introduced into said pyrolysis zone.

17. The process of claim 1, 2, 3, 4, 5 or 6 wherein said beneficially reactive gas is selected from the group consisting of steam, carbon dioxide, combustion flue gas, or mixtures thereof.

* * * * *